US009290961B2

(12) United States Patent
Nichols

(10) Patent No.: US 9,290,961 B2
(45) **Date of Patent: *Mar. 22, 2016**

(54) COLLAPSIBLE PORTABLE SHELTER

(71) Applicant: John Alexander Nichols, South Perth (AU)

(72) Inventor: John Alexander Nichols, South Perth (AU)

( * ) Notice: Subject to any disclaimer, the term of this patent is extended or adjusted under 35 U.S.C. 154(b) by 5 days.

This patent is subject to a terminal disclaimer.

(21) Appl. No.: 14/220,514

(22) Filed: Mar. 20, 2014

(65) Prior Publication Data

US 2014/0283890 A1 Sep. 25, 2014

Related U.S. Application Data

(63) Continuation of application No. 13/503,281, filed as application No. PCT/AU2010/001422 on Oct. 25, 2010, now Pat. No. 8,720,461.

(30) Foreign Application Priority Data

Oct. 23, 2009 (AU) ..... 2009905179

(51) Int. Cl.
*E04H 15/58* (2006.01)
*E04H 15/44* (2006.01)
*E04H 15/64* (2006.01)

(52) U.S. Cl.
CPC ..... *E04H 15/44* (2013.01); *E04H 15/58* (2013.01); *E04H 15/64* (2013.01)

(58) Field of Classification Search
CPC ..... E04H 15/36; E04H 15/48; E04H 15/58; E04H 15/62; E04H 15/001; E04H 15/003; E04H 15/40; E04H 15/44; E04H 15/64; E04H 15/405; A47G 9/062
USPC ..... 135/124, 125, 127, 136, 117–119, 135/120.4, 905–907; 5/417–418; D25/18–19, 56–87; D21/837, 839
See application file for complete search history.

(56) References Cited

U.S. PATENT DOCUMENTS

| | | | |
|---|---|---|---|
| 2,190,566 | A | 2/1940 | Julian |
| 2,660,186 | A | 11/1953 | Marshall et al. |
| 3,042,053 | A | 7/1962 | Gabriel |
| 3,070,107 | A | 12/1962 | Beatty |

(Continued)

FOREIGN PATENT DOCUMENTS

JP 09125748 A 5/1997

OTHER PUBLICATIONS

International Search Report for PCT/AU2010/001422, Completed by the Australian Patent Office on Nov. 26, 2010, 3 pages.

*Primary Examiner* — Winnie Yip
(74) *Attorney, Agent, or Firm* — Brooks Kushman P.C.

(57) ABSTRACT

A collapsible portable shelter including at least a first strut and a second strut, each strut being resiliently flexible, a panel formed of a flexible material coupled with the first strut and the second strut, and an anchoring member for anchoring the panel relative to a surface. The first strut is received along a first side of the panel and the second strut is received along a second side of the panel, the second side opposing the first side. The first strut and the second strut each has a portion extending beyond a third side of the panel. In use, a part of said portion of each of the first strut and second strut is to be received in the surface to resist lateral movement of said part received in the ground. Furthermore, in use, orientation with respect to the surface can be varied by adjusting the anchoring member.

20 Claims, 5 Drawing Sheets

(56) References Cited

U.S. PATENT DOCUMENTS

| | | | |
|---|---|---|---|
| 4,815,736 | A | 3/1989 | Wright |
| 5,080,123 | A | 1/1992 | Stein |
| 5,179,968 | A | 1/1993 | Deichmann |
| 5,546,971 | A | 8/1996 | Leonhardt |
| 5,823,217 | A | 10/1998 | Rice |
| 5,927,311 | A | 7/1999 | Jager |
| 7,066,526 | B2 | 6/2006 | Weddington et al. |
| 7,708,339 | B2 | 5/2010 | Zapater |
| 7,789,097 | B1 | 9/2010 | Sotirkys et al. |
| 8,181,661 | B2 | 5/2012 | Livacich et al. |

COLLAPSIBLE PORTABLE SHELTER

CROSS-REFERENCE TO RELATED APPLICATIONS

This application is a continuation of U.S. application Ser. No. 13/503,281 filed Apr. 20, 2012, now U.S. Pat. No. 8,720,461, Issued May 13, 2014, which is a U.S. national phase of PCT Application No. PCT/AU2010/001422 filed on Oct. 25, 2010 (now published as WO2011/047445A1), which claims priority to AU Patent Application No. 2009905179 filed on Oct. 23, 2009, the disclosures of which are incorporated in their entirety by reference herein.

TECHNICAL FIELD

This invention relates to a collapsible portable shelter.

BACKGROUND

The following discussion of the background art is intended to facilitate an understanding of the present invention only. It should be appreciated that the discussion is not an acknowledgement or admission that any of the material referred to was published, known or part of the common general knowledge of the person skilled in the art in any jurisdiction as at the priority date of the invention.

The invention relates to a shelter which, for example, can be used on the beach or the like in order to protect the user from exposure to the sun. One existing form of shelter comprises a beach umbrella which has a central post which is receivable in the ground. A difficulty with such umbrellas relates to the requirement that they must be oriented to minimise their resistance to the prevailing wind and to prevent them from being carried away with the wind while at the same time providing adequate protection from the sun. In addition unless properly fixed in the ground, such umbrellas can readily become dislodged and carried away as a result of strong winds which create a potential danger to other users of the beach.

Another form of shelter comprises a shell like structure which can be disassembled to be readily portable. A difficulty with such shelters is that the roof portion is located very close to the ground. They must also be oriented appropriately to accommodate for the prevailing wind conditions which in many cases are not conducive to providing adequate shelter from the sun.

SUMMARY

Throughout the specification and claims, unless the context requires otherwise, the word "comprise" or variations such as "comprises" or "comprising", will be understood to imply the inclusion of a stated integer or group of integers but not the exclusion of any other integer or group of integers.

Furthermore, throughout the specification, unless the context requires otherwise, the word "include" or variations such as "includes" or "including", will be understood to imply the inclusion of a stated integer or group of integers but not the exclusion of any other integer or group of integers.

Additionally, throughout the specification, unless the context requires otherwise, the words "substantially" or "about" will be understood to not be limited to the value for the range qualified by the terms.

According to a first aspect of the present invention, there is provided a collapsible portable shelter comprising:

at least a first strut and a second strut, each strut being resiliently flexible, a panel formed of a flexible material coupled with the first strut and the second strut, and an anchoring member for anchoring the panel relative to a surface, wherein the first strut is received along a first side of the panel and the second strut is received along a second side of the panel, the second side opposing the first side, the first strut and the second strut each has a portion extending beyond a third side of the panel, and wherein in use a part of said portion of each of the first strut and second strut is to be received in the surface to resist lateral movement of said part received in the ground, and wherein in use an orientation of the panel with respect to the surface can be readily varied by adjusting the anchoring member.

Preferably, the anchoring member comprises a weight element for positioning on the surface so as to anchor the panel relative to the surface.

Preferably, the anchoring member further comprises a cord, wherein in use, a first portion of the cord is affixed to at least one of the first strut and the second strut and a second portion of the cord is affixed to the weight element to secure the panel to the weight element.

Preferably, the anchoring member is capable of being adjusted by re-positioning the weight element.

Preferably, the anchoring member is capable of being adjusted by varying the length of the cord between the strut and the weight element.

Preferably, said anchoring member is a first anchoring member, the cord of the first anchoring member is affixed to the first strut and the first weight element, and the collapsible portable shelter further comprises a second anchoring member, the second anchoring member comprises a second weight element and a second cord, wherein a first portion of the second cord is affixed to the second strut and a second portion of the second cord is affixed to the second weight element to secure the panel to the second weight element.

Preferably, the weight element comprises a bag having an opening, the cord is received around the opening such that tensioning of the cord closes the opening.

Preferably, the bag is adapted to be filled with sand.

Preferably, the collapsible portable shelter further comprises a brace element for coupling with the first strut and the second strut.

Preferably, the brace element is received transversely between the first strut and the second strut intermediate of the third side and a fourth side of the panel, the fourth side opposing the third side.

Preferably, the first portion of the cord is affixed to the strut at a location between the brace element and fourth side of the panel.

Preferably, the first portion of the cord is affixed to an end of the strut such that the cord can be rotated at the end about the central axis of the strut.

Preferably, the length of the brace element being such that when engaged with the first and second struts the panel is tensioned.

Preferably, at least one of the first and second struts comprises a plurality of elongate members which can be connected together to form the strut.

Preferably, the plurality of elongate members are connected in an end to end relationship to form the strut.

Preferably, the brace element is affixed to the strut at a position proximate to the interconnection of two elongated members.

Preferably, at least two of the elongate members are pivotally interconnected.

Preferably, the elongate members are separable from each other and connectable ends of the elongate members are provided with complementary spigot and socket.

Preferably, wherein the strut is tapered such that said part of the strut to be received in the ground is of a reduced diameter compared to the other end portion of the strut.

Preferably, the strut is of a substantially constant diameter throughout its length.

Preferably, said portion of the first and second strut is a lower portion and the remaining portion of the first and second strut is an upper portion, and wherein the first strut and the second strut are configured to curve such that, when in use, the distance between the lower portions of the struts are smaller than the distance between the upper portions of the struts.

Preferably, the panel has a shape which is substantially quadrilateral.

Preferably, the panel has a flap portion extending from at least one of the first side and the second side of the panel.

Preferably, the collapsible portable shelter further comprises a portable container for storing the shelter when in a collapsed form.

Preferably, the portable container comprises a first eyelet and a second eyelet, wherein when erecting the shelter, the portable container is laid on the surface and the first eyelet and the second eyelet indicate positions on the surface where the first end portion of the first strut and the second strut should respectively be inserted.

According to a second aspect of the present invention, there is provided a collapsible portable shelter comprising a pair of struts, said struts being resiliently flexible and comprising a plurality of elongate portions which can be connected in an end to end relationship to form the strut, the collapsible portable shelter further comprising a panel formed of a sheet material and having substantially the shape of a quadrilateral, the struts being received in opposed sides of the panel and end portions of the struts extending from beyond one end of the panel, a brace element received between the struts intermediate of the ends of the panel, the length of the brace element being such that when engaged with the struts the panel is tensioned, wherein in use the end portions of the struts are to be received in the ground to resist lateral movement of the end portions which are received in the ground, wherein in use cords are affixed to the struts towards their other ends, said cords being intended in use to be attached to a support element supported from the ground to cause the struts to flex and locate the panel at an oblique angle to the ground.

According to a preferred feature of the invention the portions of the strut which are received in the respective sides of the panel comprise a pair of said elongate members. According to a preferred feature of the invention the brace element is received proximate the interconnection between the pair of elongate members.

According to a preferred feature of the inventions at least some of the elongate portions are pivotally interconnected. According to one embodiment of the invention the pair of elongate members are pivotally connected. According to an alternative preferred feature of the invention the elongate portions are separable from each other and the interengaging ends are provided with complementary spigot and socket.

According to a preferred feature of the invention the struts are tapered whereby the end portion is of a reduced diameter compared to the other end of the strut. According to one embodiment of the invention incorporating this feature the sides of panel are divergent in the direction from the one end of the panel to the other end of the panel.

According to an alternative preferred feature of the invention the struts are of a substantially constant diameter throughout their length. According to one embodiment of the invention incorporating this feature the sides of the panel are curved outwardly between the ends of the panel.

According to a preferred feature of the invention the cords are connected to the struts at a position spaced from the other end of the strut.

According to a preferred feature of the invention the cords are capable of being varied in length.

According to a preferred feature of the invention the support elements comprise weight elements fixed to the other ends of the cord. According to a preferred feature of the invention the weight members comprise bags having an opening which is associated with the cord, whereby tensioning of the cord causes closure of the opening.

The invention will be more fully understood in the light of the following description of several specific embodiments.

BRIEF DESCRIPTION OF THE DRAWINGS

The description is made with reference to the accompanying drawings of which.

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

FIGS. 1 to 6 illustrate a collapsible portable shelter 2 in various states according to a first embodiment of the present invention.

Figure 1:
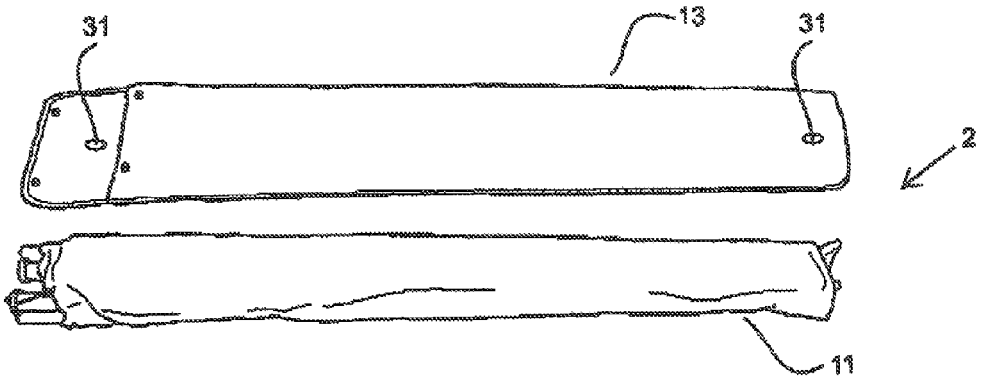
FIG. 1 is a view of rolled up collapsible portable shelter according to the first embodiment and its associated carry bag.
Figure 2:
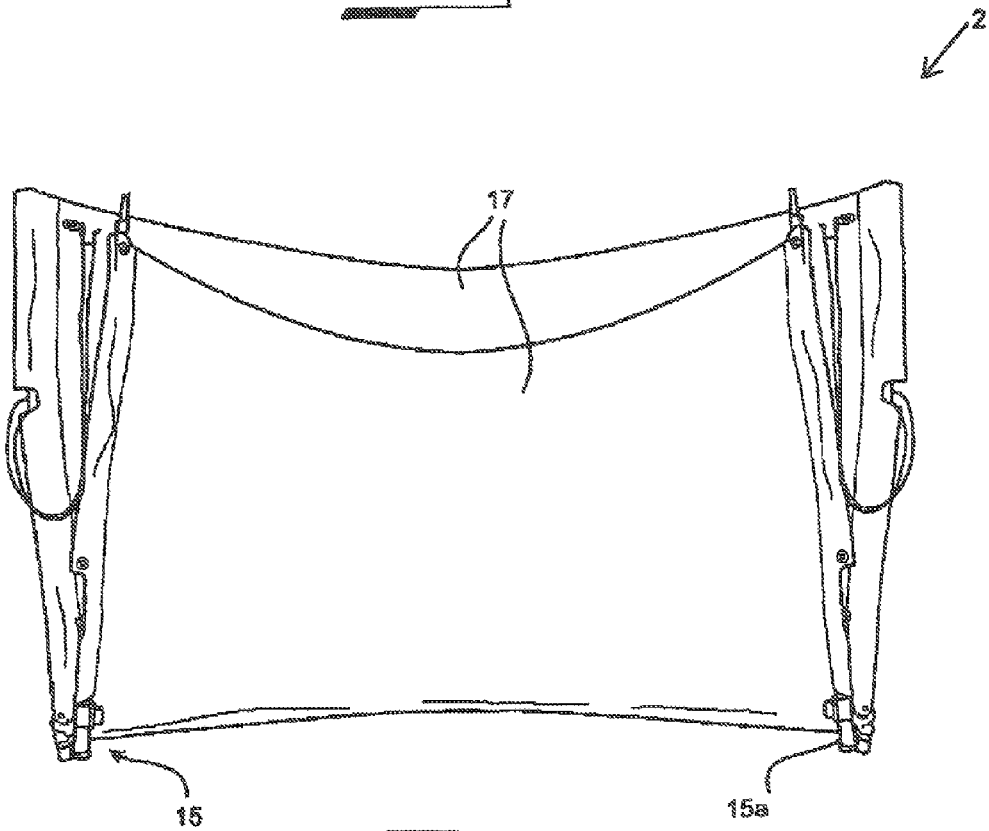
FIG. 2 is a plan view of the shelter according to the first embodiment when unrolled.

FIG. 1 shows the shelter 2 collapsed completely into a bundle 11 which can be inserted into a portable container 13, such as a carry bag. When it is desired to erect the shelter 2, the bundle 11 is extracted from the carry bag 13 and the panel 17 of the shelter 2 is unrolled as shown in FIG. 2. The panel 17 can then be unfolded to begin erecting the shelter 2.

The shelter 2 of the first embodiment comprises at least a first strut 15 and a second strut 15, each strut 15 being resiliently flexible. It should be noted that further struts can be provided to enhance the strength and/or stability of the shelter 2. The shelter 2 further comprises a panel 17 formed of a flexible material, such as a suitable fabric material. Preferably, the material is substantially opaque to sunlight. Alternatively, or additionally, the material is substantially capable of blocking wind from passing through. For example, the panel 17 may generally have the configuration of a quadrilateral.

The shelter 2 also comprises at least one anchoring member 28 (see FIG. 6) for anchoring the panel 17 relative to a surface. Preferably, the surface is a ground such as a beach, but may also be a wall where appropriate. The anchoring member 28 comprises a weight element 29 and a cord 27. A first portion of the cord 27, such as an end portion, is affixed to an upper portion 15*a* of the strut 15 and a second portion of the cord 27, such as the other end portion, is attached to the weight element in order to secure the panel 17 to the weight element so as to anchor the panel 17 to the ground.

Figure 6:
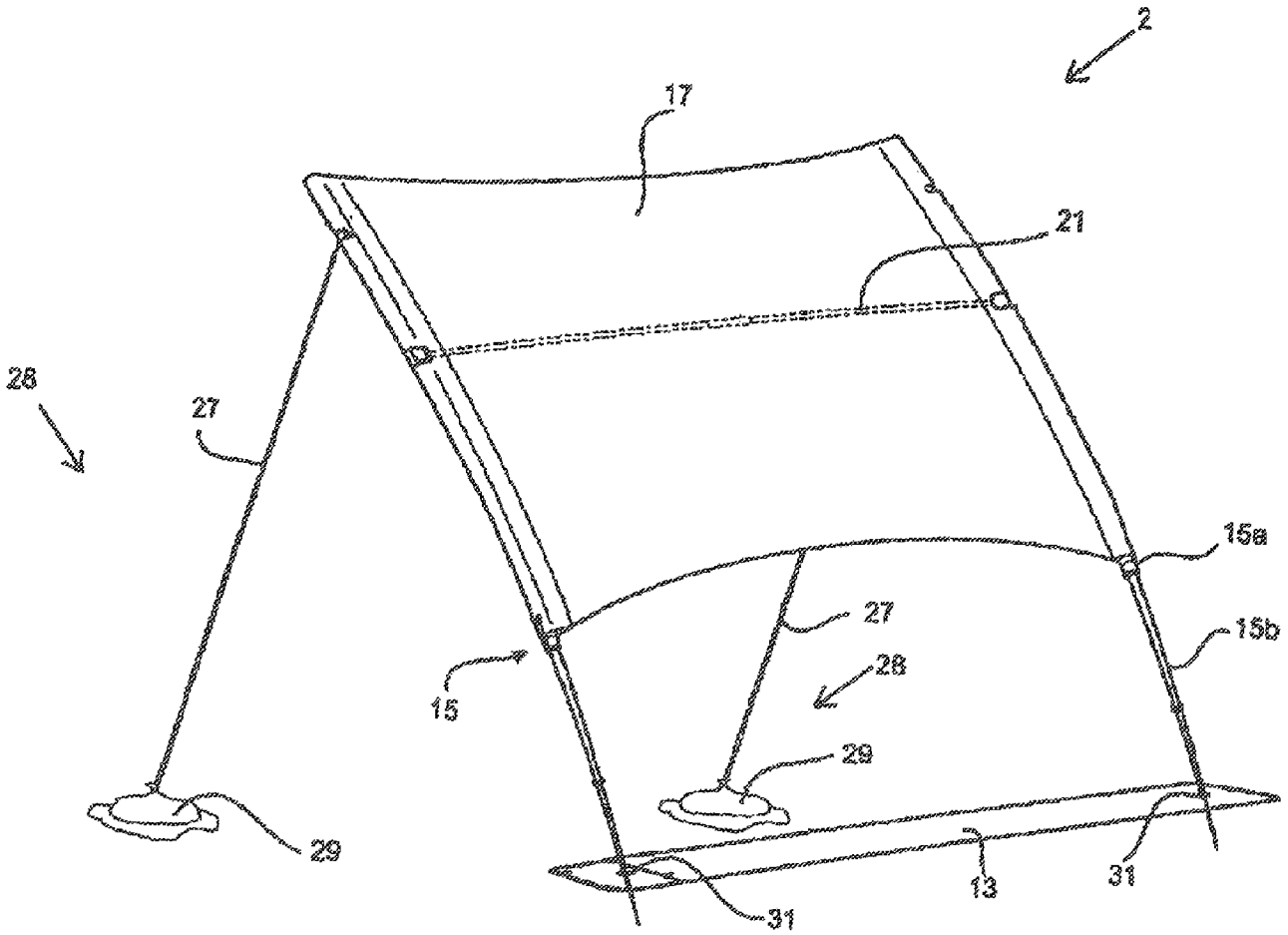
FIG. 6 is a rear isometric view of the shelter of the first embodiment in the flexed state.

In the embodiment as shown in FIG. 6, two anchoring members 28, a first anchoring member 28 and a second anchoring member 28, are provided for the shelter 2, one anchoring member 28 for each of the first strut 15 and the second strut 15. In this case, the first anchoring member 28 is affixed to the first strut 15 and the second anchoring member 28 is affixed to the second strut 15 in the same manner as described above. Therefore, the panel 17 is anchored to the ground via the first and second anchoring members 28.

The panel 17 can be anchored to the ground via the first and second anchoring members 28 to achieve a desirable orientation, for example, for blocking the sun from an area of the ground where shading is desired. In particular, the orientation of the panel 17 with respect to the ground can be readily varied by adjusting the anchoring member 28. For example, the anchoring member 28 can be adjusted by re-positioning the weight element 29 or by adjusting the length of the cord 27.

Although the embodiment as shown in FIG. 6 depicts two anchoring members 28, this is not necessary and one anchoring member may be sufficient. For example, a cord may be tied to both the first strut 15 and the second strut 15 and the weight member so as to form a substantial Y-shape (not shown). Therefore, in this case, only one anchoring member may is necessary.

The panel 17 is coupled with the first strut 15 and the second strut 15. In this embodiment, the first and second struts 15 are received in a hem or sleeve formed in the respective sides of the panel 17, such as a first side of the panel and a second side of the panel opposing the first side, as illustrated in FIGS. 2 to 6. Each of the first and second struts 15 has a lower portion 15*b* extending beyond a third side of the panel 17. In the case of the panel 17 being a quadrilateral, the third side is the bottom side of the panel 17 generally transverse to the first and second sides. In an embodiment of the present invention, the panel 17 has a flap portion (not shown) extending from at least one of the above-mentioned sides of the panel 17.

Preferably, the first and second struts 15 are each formed from a plurality of elongate members which can be interconnected end to end to form the strut 15. The upper portion 15*a* of each strut 15 which is accommodated in the hem or sleeve of the panel 17 is preferably formed of two of the elongate members which are to be connected end to end and in this regard the proximate connectable ends of the elongate members are formed as a complementary socket and spigot. The proximate connectable ends of the elongate members are interconnected by an extensible or elastic cord 19 which is fixed at its respective ends within each of the two elongate members. The elastic cord 19 serves to retain the elongate members together when the two elongate members are disconnected.

The panel 17 has a cut-out portion 20 in the region of the junction of the two elongate members which define the upper portion 15*a* of the first strut 15 to facilitate access to the proximate connectable ends of the two elongate members. The panel 17 also has a cut-out portion 20 in the region of the junction of the two elongate members which define the upper portion 15*a* of the second strut 15.

The shelter further comprises a brace element 21 for coupling with the first and second struts. The brace element 21 is received transversely between the first and second struts 15. Each of the struts 15 has a support bracket 25 affixed thereto in the region of the junction of the two elongate members which define the upper portion 15*a* of the strut 15. Preferably, each support bracket 25 is visible or is accessible through the corresponding cut-out portion 20 of the panel 17 in order to assist in affixing the brace element 21 to the support bracket 25. The brace element 21 has two ends, each is receivable in a socket 23 provided in the corresponding support bracket 25. Preferably, the brace element 21 is formed of two of elongate portions which are to be connected end to end and in this regard the proximate connectable ends of the elongate portions are formed as a complementary socket and spigot. The connectable proximate ends of the elongate portions are interconnected by an elastic or extensible cord (not shown) which is fixed at its respective ends within each of the two elongate portions. The elastic cord serves to retain the elongate portions together when the two elongate portions are disconnected.

Figure 3:
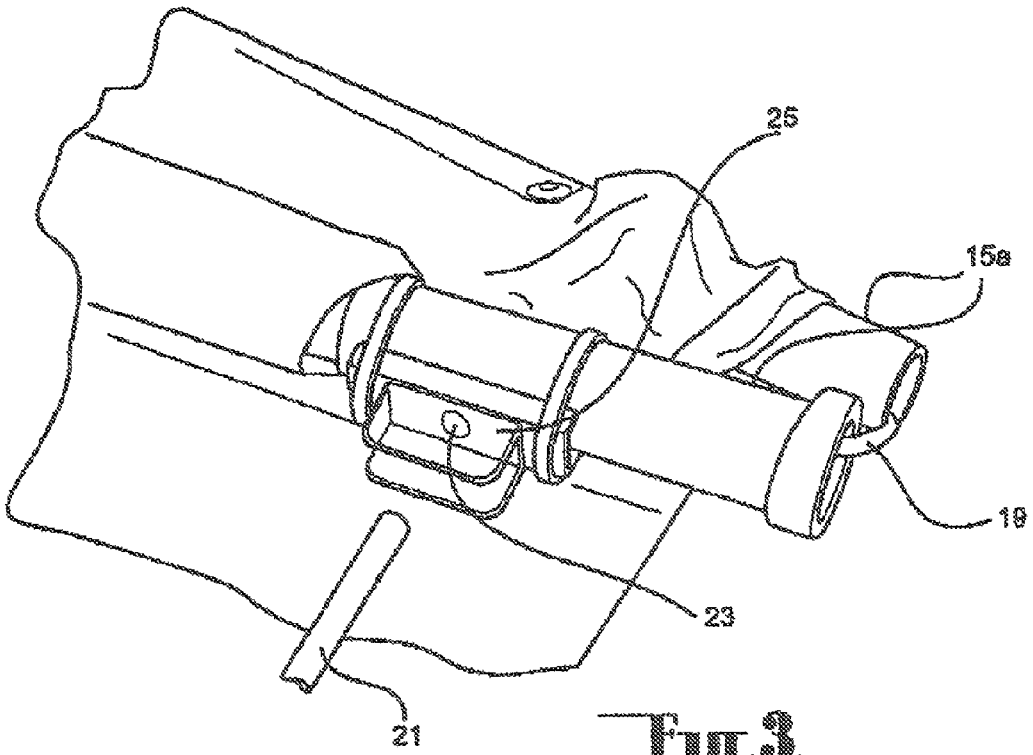
FIG. 3 is an enlarged part isometric view showing the interconnection between the pair of elongate members of the portion of the strut accommodated in one side of the panel showing the brace element prior to its engagement with the strut.
Figure 4:
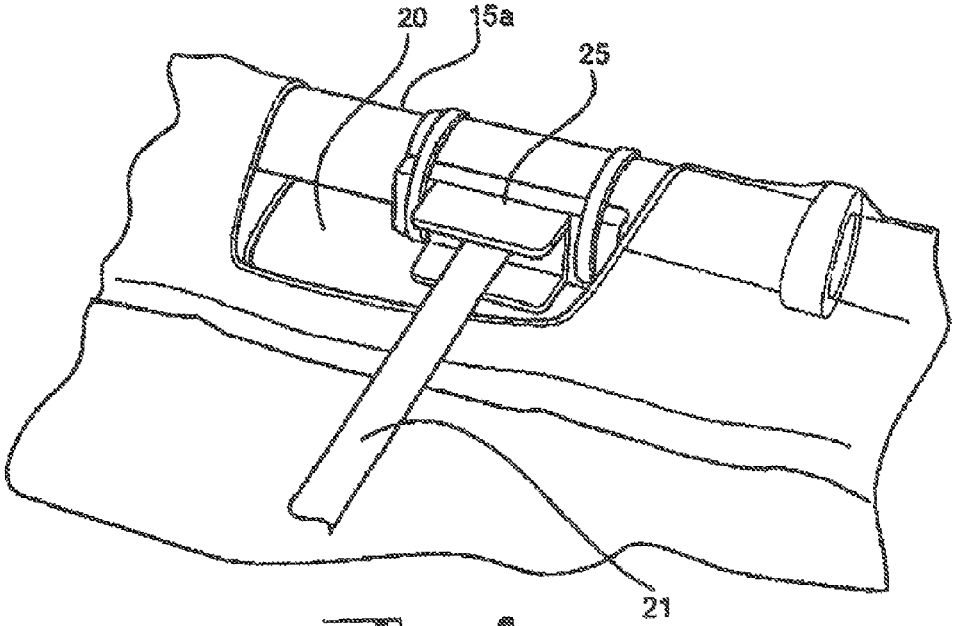
FIG. 4 is an enlarged part isometric view showing the interconnection between the pair of elongate members of the portion of the strut accommodated in one side of the panel showing the brace element in engagement with the strut.

A close-up view of the support bracket 25 according to the first embodiment is shown in FIGS. 3 and 4. The support bracket 25 comprises a channel section where the spacing between the flanges of the channel section substantially corresponds to the thickness of the brace element 21. In use the ends of the brace element 21 are engaged in the sockets 23 of the first and second struts 15. The length of the brace element 21 is such that when the ends 21 are received in the sockets 23 of the first and second struts 15, the panel 17 is tensioned.

The portions of the panel 17 to either side of the cut-out portion 20 are interconnected by a tie or the like (not shown) which is slidably received in the support bracket 25. The presence of the tie and its connection to the support bracket 25 serves to limit the relative longitudinal displacement between the panel 17 and the elongate member when the panel 17 is in the collapsed state.

As described above, the anchoring member 28 comprises a weight element 29 and a cord 27. Preferably, the cord 27 is adjustable in length. In the embodiment as shown in FIG. 6, the weight element 29 comprises a bag formed of a flexible fabric or sheet material having an opening whereby the cord 27 is received around the opening such that on the tensioning of the cord 27 the opening is closed. The cord 27 may be a single integral cord or may be made up of two or more cords. For example, there may be provided a first cord which is affixed to the strut 15 and a second cord which is received around the opening forming a loop. The first cord has a latching member (not shown) such as a hook at an end portion for latching onto the second cord. With this configuration, on tensioning of the cord 27, the opening can also be closed.

Preferably, the mounting of the cords 27 to the struts 15 is such that it will permit rotation of the cord 27 about the central axis of the strut 15.

The carry bag 13 is provided with a first eyelet 31 and a second eyelet 31 which are spaced from each other according to the desired spacing of the lower end portion 15*b* of the struts 15 when they are to be inserted into the ground. That is, the first eyelet 31 and the second eyelet 31 indicate positions on the ground where the lower end portion 15*b* of the first strut 15 and the second strut 15 should respectively be inserted.

In erecting the collapsible shelter 2 according to the first embodiment of the present invention, the carry bag 13 is laid over the ground in a location where the shelter 2 is to be erected. The lower portions 15*b* of the struts 15 are then inserted into the respective eyelets 31 and into the ground such that they are positively retained in the ground to be resistant to lateral movement. The elongate members of the first strut 15 and the second strut 15 supported respectively in the hem or sleeves of the first and second sides of the panel 17 are interconnected in an end to end relationship to form the upper portion 15*a* of the respective strut 15. The upper portion 15*a* of each of the first and second struts 15 is then respectively interconnected to an end of the lower portion 15*b* of each of the first and second struts 15 to form assembled struts 15. When the first and second struts 15 are assembled and the other end of the lower portion 15*b* is inserted into the ground, the panel 17 is generally upright with respect to the ground. The elongate portions which make up the brace element 21 are then interconnected and the brace member 21 is located between the first and second struts 15 with its ends received in the socket 23 of the support bracket 25 affixed on each of the first and second struts 15. In the embodiment where the weight element 29 is a bag, the bags 29 are then filled with objects, such as sand, and are located at position in front of the shelter 2 to cause the shelter 2 to flex. The degree of flexure of the shelter can be varied by varying the length of the cords 27 or by re-positioning the bags.

Figure 5:
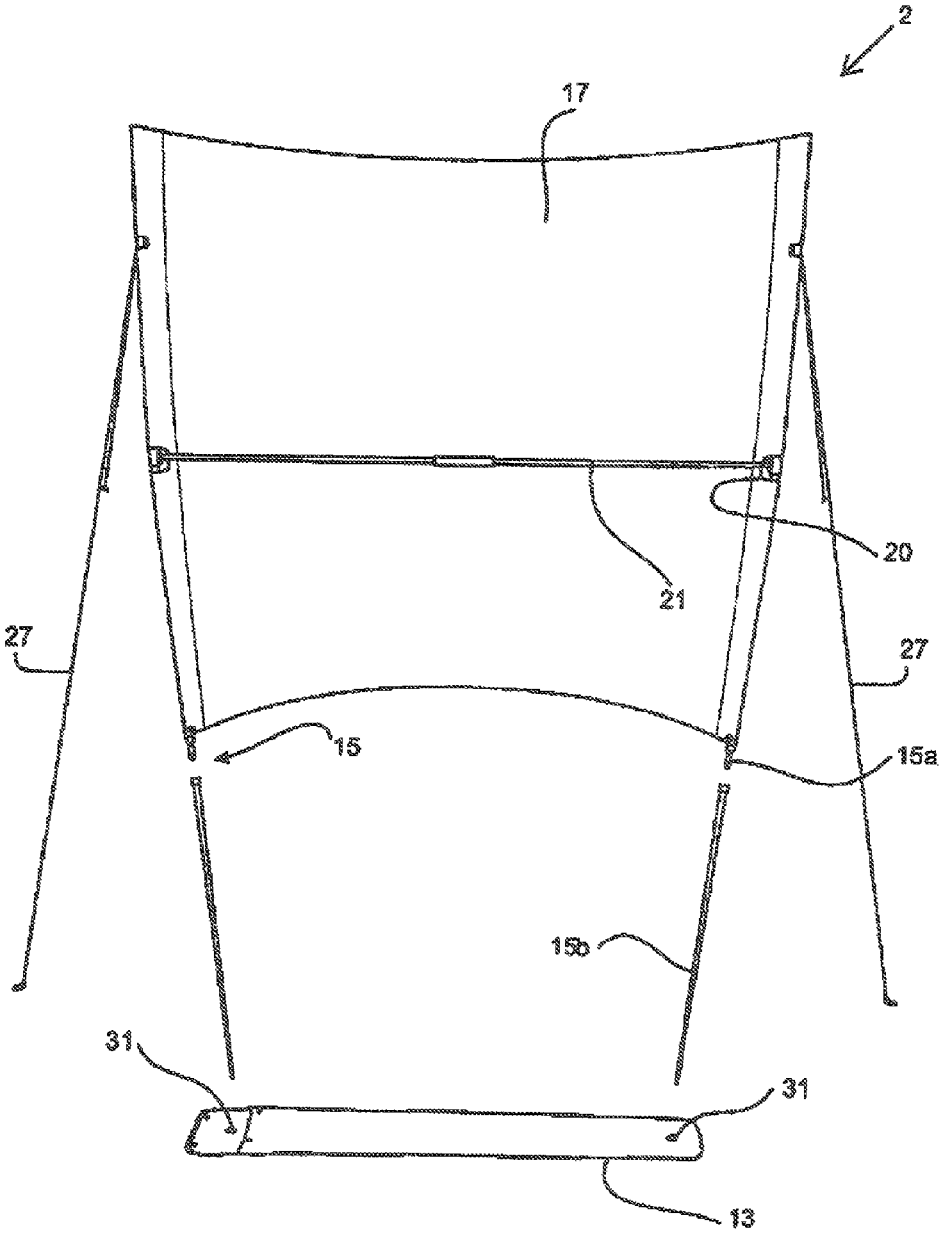
FIG. 5 is a plan view of the shelter of the first embodiment in the unflexed state.

For example, as shown in FIG. 5, the cord 27 may be looped over the strut 15 and then secured onto itself via an attachment device at a position along the length of the cord 27 between the first portion (i.e., the portion affixed to the strut 15) and the second portion (i.e., the portion affixed to the weight element 29). Therefore, the length of the cord 27 may be effectively lengthened by securing the end of the cord 27 at a position closer to the strut 15 at which the cord 27 is looped over. On the other hand, the length of the cord 27 may be effectively shortened by securing the end of the cord 27 at a position closer to the weight element 29.

In the case of the first embodiment as shown in FIGS. 1 to 6, the first and second struts 15 are tapered wherein the ends which are to be inserted into the ground have the smallest diameter. In addition, the first and second sides of the panel 17 are divergent in the direction from the one end to the other end. As a result when the shelter is erected the struts have a divergent orientation with respect to each other.

Figure 7:
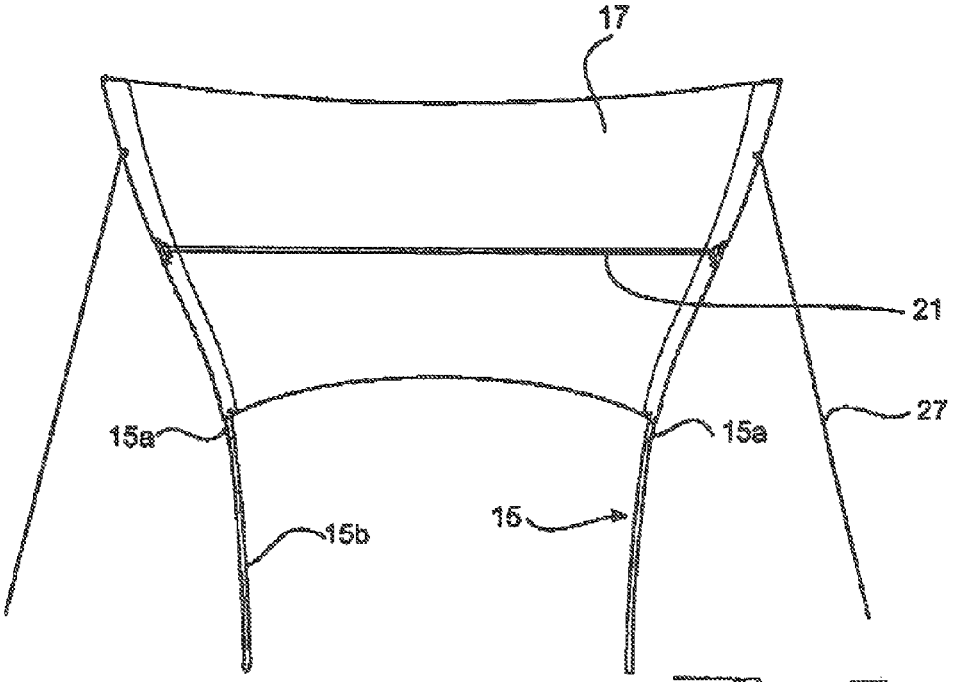
FIG. 7 is a front isometric view of the shelter of the second embodiment in the flexed state.
Figure 8:
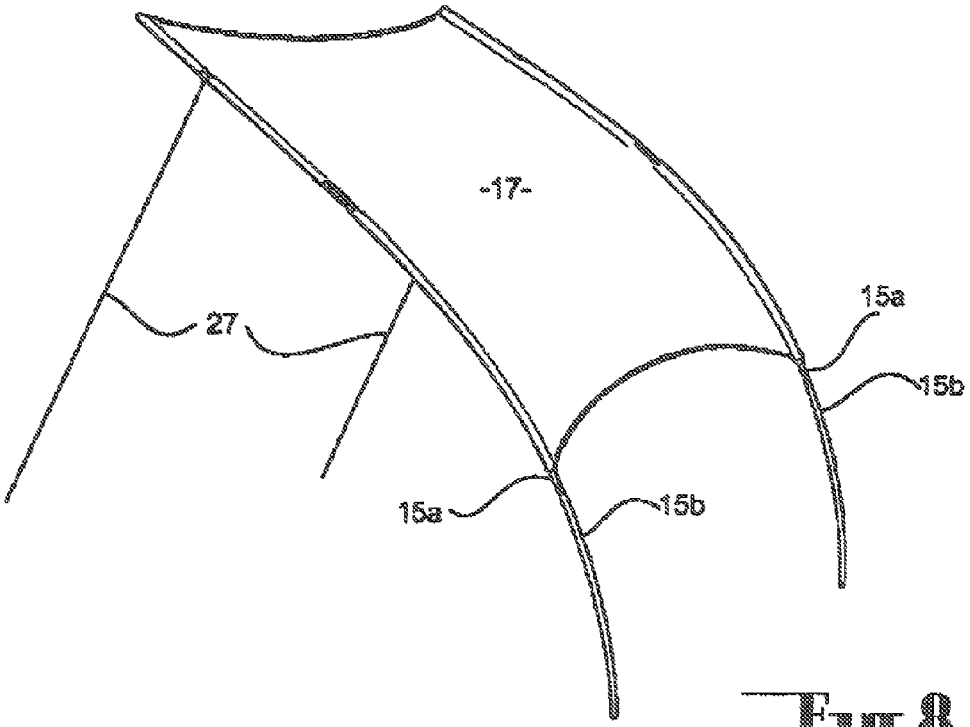
FIG. 8 is a rear isometric view of the shelter of the second embodiment in the flexed state.

In the case of the second embodiment as shown at FIGS. 7 and 8 the struts 15 are of a constant diameter throughout their length. In addition, the first and second sides of the panel 17 are curved outwardly between the ends. That is, the first and second struts 15 are configured to curve such that, when in use, the distance between the lower portions 15*b* of the struts 15 are smaller than the distance between the upper portions of the struts 15. As a result when the shelter is erected the struts 15 have an opposed bowed configuration as shown.

According to an alternative embodiment the two elongate members which are supported within the hem or sleeve of the panel 17 can be hingedly interconnected which is associated with a locking means which can retain the elongate members in their co-linear orientation. In addition the support bracket 25 of the above embodiments can comprise an element which is formed as an integral part of the hinged connection.

The collapsible shelter according to the first and second embodiments provides a shelter 2 which can readily withstand windy conditions. As a result of trials it has been found that when the shelter 2 is erected such that the cords 27 are located downwind the aerodynamics of the shelter 2 are such that the shelter 2 is stable and under strong wind conditions it is expected that while the shelter 2 may be flattened it will not become dislodged. In addition the degree of flexure of the shelter can be varied according to the shade requirements by varying the length of the cords and/or the position of the sand filled bags 29. Furthermore it is possible to flex the shelter 2 in the opposite direction in the event of the shade requirements varying as result of the movement of the sun or changing wind conditions without disengaging the lower portions 15*b* of the struts 15 from the ground.

The present invention is not to be limited in scope by any of the specific embodiments described herein. These embodiments are intended for the purpose of exemplification only. Functionally equivalent products and methods are clearly within the scope of the invention as described herein.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A collapsible portable shelter comprising:

at least a first strut and a second strut, each strut being resiliently flexible;

a panel formed of a flexible material coupled to and spanning between the first strut and the second strut;

the first strut being received along a first side of the panel and the second strut being received along a second side of the panel, the second side opposing the first side;

the first strut and the second strut further comprising a portion extending beyond a third side of the panel, the portion including a lower end for penetrating into a ground to render said struts resistant to lateral movement, when inserted in the ground; and a non-rigid anchoring member for anchoring the panel relative to the ground, said anchoring member comprising a weight element, and a tensile member attached to the weight element and attached to an upper portion of the first strut for applying a downward force causing the struts to flex;

wherein, in use, said lower end of each of the first strut and second strut is received in the ground and said anchoring member, when attached to said struts, causes said flex of said struts and the flex applied to the struts by the anchoring member and the force applied to said struts by their location in the ground acts to support and anchor the shelter to the ground, when erected, and wherein in use an orientation of the panel with respect to the ground can be varied by adjusting the anchoring member.

2. The collapsible portable shelter according to claim 1, wherein the tensile member is a cord member.

3. The collapsible portable shelter according to claim 2, wherein the amount of flex applied to said struts is capable of being adjusted by varying the length of said cord member.

4. The collapsible portable shelter according to claim 2 wherein the weight element comprises a bag having an opening and the cord member is received around the opening of the bag such that tensioning of the cords closes the openings of the bags.

5. The collapsible portable shelter according to claim 1, wherein the anchoring member is capable of being adjusted by re-positioning the weight element.

6. The collapsible portable shelter according to claim 1, wherein said weight element comprises first and second weight members, one weight member being for attachment to the first strut and the other weight member being for attachment to the second strut.

7. The collapsible portable shelter according to claim 1, further comprising a brace element for coupling the first strut and the second strut.

8. The collapsible portable shelter according to claim 7, wherein the brace element is received transversely between the first strut and the second strut intermediate of the third side and a fourth side of the panel, the fourth side opposing the third side.

9. The collapsible portable shelter according to claim 8, wherein the weight element is attached to the strut at a location between the brace element and the fourth side of the panel.

10. The collapsible portable shelter according to claim 7, wherein the length of the brace element is such that when engaged with the first and second struts the panel is tensioned.

11. The collapsible portable shelter according to claim 1, wherein at least one of the first and second struts comprises a plurality of elongate members which can be connected together to form the strut.

12. The collapsible portable shelter according to claim 11, wherein the plurality of elongate members are connected in an end to end relationship to form the strut.

13. The collapsible portable shelter according to claim 11 wherein the brace element is affixed to the strut at a position proximate to the interconnection of two elongate members.

14. The collapsible portable shelter according to claim 11, wherein at least two of the elongate members are pivotally interconnected.

15. The collapsible portable shelter according to claim 1, wherein the lower end is tapered for easier insertion into the ground.

16. The collapsible portable shelter according to claim 15, wherein each strut includes an upper portion opposite the lower portion, and wherein the first strut and the second strut are configured to curve such that, when in use, the distance between the upper portions of the struts is greater than the distance between the lower portions.

17. The collapsible portable shelter according to claim 1, wherein the strut is of a substantially constant diameter throughout its length.

18. The collapsible portable shelter according to claim 1, wherein the panel has a shape which is substantially quadrilateral.

19. The collapsible portable shelter according to claim 1, further comprising a portable container for storing the shelter when in a collapsed form.

20. The collapsible portable shelter according to claim 19, wherein the portable container comprises a first eyelet and a second eyelet, wherein when erecting the shelter, the portable container is laid on the surface and the first eyelet and the second eyelet indicate positions on the surface where the first end portion of the first strut and the second strut should respectively be inserted.

* * * * *